US011077683B2

(12) United States Patent
Yamaguchi et al.

(10) Patent No.: US 11,077,683 B2
(45) Date of Patent: Aug. 3, 2021

(54) IMAGE FORMING APPARATUS AND STORAGE MEDIUM

(71) Applicant: BROTHER KOGYO KABUSHIKI KAISHA, Nagoya (JP)

(72) Inventors: Masatomo Yamaguchi, Inazawa (JP); Hirotaka Aoki, Nagoya (JP); Masao Mimoto, Kitanagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/802,751

(22) Filed: Feb. 27, 2020

(65) Prior Publication Data

US 2020/0276838 A1 Sep. 3, 2020

(30) Foreign Application Priority Data

Feb. 28, 2019 (JP) ..... JP2019-036252

(51) Int. Cl.
*B41J 3/01* (2006.01)
*B41J 13/00* (2006.01)

(52) U.S. Cl.
CPC ..... *B41J 13/0009* (2013.01)

(58) Field of Classification Search
CPC ..... B41J 11/008; B41J 3/01; B41J 2/04508
See application file for complete search history.

(56) References Cited

U.S. PATENT DOCUMENTS 8,282,525 B2 * 10/2012 Oliver ..... F16H 63/065 476/10
10,719,746 B2 * 7/2020 Goto ..... B41J 19/142
2006/0053137 A1 * 3/2006 Tanimoto ..... G06F 16/381
2007/0217852 A1 * 9/2007 Handa ..... B41J 3/4075 400/615.2
2018/0065359 A1 3/2018 Yamaguchi et al.

FOREIGN PATENT DOCUMENTS

JP 2005-047168 A 2/2005
JP 2018-041221 A 3/2018

* cited by examiner

*Primary Examiner* — Lam S Nguyen
(74) *Attorney, Agent, or Firm* — Scully, Scott, Murphy & Presser, PC

(57) ABSTRACT

An image forming apparatus configured to: decide a conveying distance for a conveying processing based on image data stored in a memory; and shorten, in a case where it is determined that a code image is to be formed by a plurality of scanning processing including a first scanning processing and a second scanning processing, the decided conveying distance for: (i) one conveying processing which is executed immediately before the first scanning processing; or (ii) at least one of a plurality of conveying processing which are respectively executed immediately before each of a plurality of scanning processing which includes the first scanning processing and at least one scanning processing executed before the first scanning processing, so that the code image is not to be formed in the first scanning processing and the code image is started to be formed from the second scanning processing.

8 Claims, 7 Drawing Sheets

| |
|---|
| FIG. 6A |
| FIG. 6B |

IMAGE FORMING APPARATUS AND STORAGE MEDIUM

CROSS-REFERENCE TO RELATED APPLICATIONS

This application is based upon and claims the benefit of priority from prior Japanese patent application No. 2019-036252, filed on Feb. 28, 2019, the entire contents of which are incorporated herein by reference.

TECHNICAL FIELD

The present disclosure relates to an image forming apparatus and a storage medium storing a program configured to print a code image.

BACKGROUND ART

In standards of one-dimensional code (barcode), a ratio of widths of a bar and a space between two adjacent bars is prescribed. When reading a printed barcode image, the ratio of the widths of the bar and the space of the barcode image may deviate from a reference range. In this case, a reading error occurs. This also applies to a two-dimensional code.

A serial printer, which is adopted for an inkjet printer in many cases, alternately performs sheet conveying in a conveying direction of a sheet and image recording on the sheet by a recording head mounted to a carriage configured to reciprocally move in a scanning direction perpendicular to the conveying direction. In the serial printer, when an alignment direction of a plurality of bars of one-dimensional code coincides with the conveying direction, if a conveying distance for a conveying processing performed during the recording of one-dimensional code is shifted, the ratio of the width of the bar and the space deviates from the reference range, so that a reading error is likely to occur.

Related art discloses an inkjet recording apparatus in which when a code image cannot be printed by one scanning, boundary of a plurality of scanning are made not to extend over constitutional elements of a two-dimensional code, so that lowering in reading accuracy of the two-dimensional code due to recording position shift of an image can be suppressed.

However, even when the technology disclosed in the related art is used, if a conveyance error in the conveying processing executed during the formation of the code image increases, the reading error occurs frequently.

SUMMARY

It is therefore an object of the present disclosure to provide an image forming apparatus and a storage medium storing a program capable of printing a code image having high reading accuracy.

According to an aspect of the present disclosure, there is provided an image forming apparatus including: a memory; a recording head configured to record an image on a recording medium based on image data stored in the memory; a conveyor unit configured to convey the recording medium in a conveying direction; a carriage having the recording head mounted thereto and capable of reciprocally moving in a scanning direction perpendicular to the conveying direction; and a controller configured to: execute a conveying processing in which the recording medium is conveyed in the conveying direction by the conveyor unit; execute a scanning processing in which the image is recorded on the recording medium by the recording head with moving the carriage in the scanning direction when the conveying processing is not executed; decide a conveying distance for the conveying processing based on the image data stored in the memory; determine whether an image including a code image having a plurality of printing regions and a plurality of non-printing regions is to be formed on the recording medium based on the image data stored in the memory; determine, in a case where it is determined that the image including the code image is to be formed on the recording medium, whether the code image is to be formed by a plurality of the scanning processing including a first scanning processing and a second scanning processing if the conveying processing is executed over the decided conveying distance; and shorten, in a case where it is determined that the code image is to be formed by the plurality of scanning processing, the decided conveying distance for: (i) one conveying processing which is executed immediately before the first scanning processing; or (ii) at least one of a plurality of conveying processing which are respectively executed immediately before each of a plurality of scanning processing which includes the first scanning processing and at least one scanning processing executed before the first scanning processing, so that the code image is not to be formed in the first scanning processing and the code image is started to be formed from the second scanning processing, wherein a length of the code image in the conveying direction, which is formed in the first scanning processing when the decided conveying distance is not shortened, is shorter than a length of the code image in the conveying direction, which is formed in the second scanning processing when the decided conveying distance is shortened.

According to another aspect of the present disclosure, there is provided a non-transitory computer readable storage medium storing a program used for an electronic device configured to control an image forming apparatus, the image forming apparatus including: a memory; a recording head configured to record an image on a recording medium based on image data stored in the memory; a conveyor unit configured to convey the recording medium in a conveying direction; a carriage having the recording head mounted thereto and capable of reciprocally moving in a scanning direction perpendicular to the conveying direction; and a controller configured to: execute a conveying processing in which the recording medium is conveyed in the conveying direction by the conveyor unit, and execute a scanning processing in which the image is recorded on the recording medium by the recording head with moving the carriage in the scanning direction when the conveying processing is not executed, the program, when executed by a processor of the electronic device, causes the electronic device to: store image data in the memory; decide a conveying distance for the conveying processing based on the image data stored in the memory; determine whether an image including a code image having a plurality of printing regions and a plurality of non-printing regions is to be formed on the recording medium based on the image data stored in the memory; determine, in a case where it is determined that the image including the code image is to be formed on the recording medium, whether the code image is to be formed by a plurality of the scanning processing including a first scanning processing and a second scanning processing if the conveying processing is executed over the decided conveying distance; and shorten, in a case where it is determined that the code image is to be formed by the plurality of scanning processing, the decided conveying distance for: (i) one conveying processing which is executed immediately before the first scanning processing; or (ii) at least one of a plurality of conveying processing which are respectively executed immediately before each of a plurality of scanning processing which includes the first scanning processing and at least one scanning processing executed before the first scanning processing, so that the code image is not to be formed in the first scanning processing and the code image is started to be formed from the second scanning processing, and wherein a length of the code image in the conveying direction, which is formed in the first scanning processing when the decided conveying distance is not shortened, is shorter than a length of the code image in the conveying direction, which is formed in the second scanning processing when the decided conveying distance is shortened.

DESCRIPTION OF EMBODIMENTS

Hereinafter, an inkjet printer (hereinafter, simply referred to as "printer") in accordance with a preferable embodiment of the present disclosure will be described with reference to the drawings. In descriptions below, an upper and lower direction is defined based on a state (a state shown in FIG. 1) in which the printer 10 is usably equipped, a front and rear direction is defined based on a side (a front side; a front face) of a housing 11 on which an opening 13 is provided, and a right and left direction is defined when the printer 10 is seen from the front side (front face).

Figure 1:
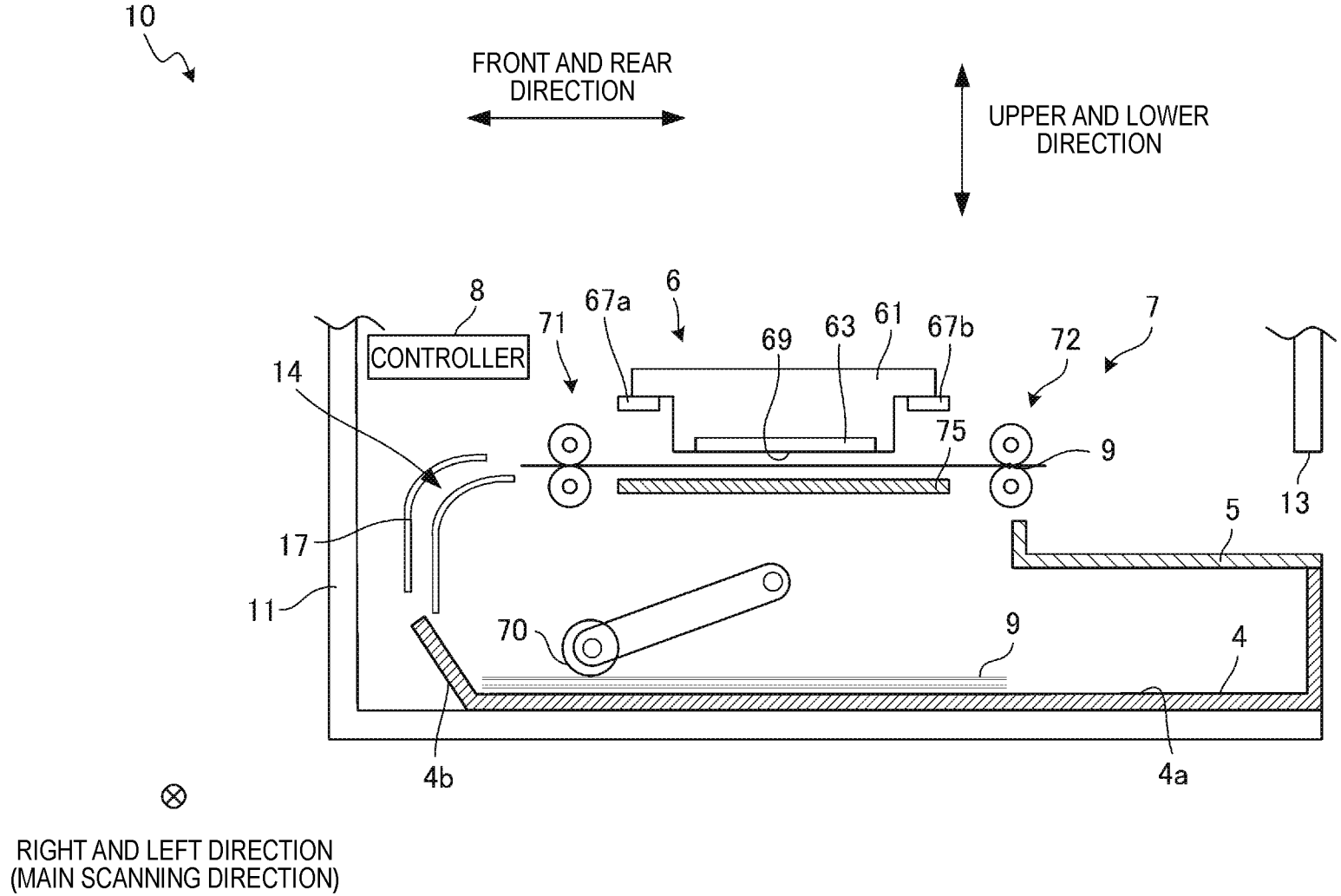
FIG. 1 is a schematic side view depicting an internal structure of a printer in accordance with an embodiment of the present disclosure.

As shown in FIG. 1, the printer 10 includes a sheet feeding tray 4, a sheet discharge tray 5, a recording unit 6, a conveyor unit 7, a controller 8, and the like. The sheet feeding tray 4, the recording unit 6, the conveyor unit 7, and the controller 8 are accommodated in the housing 11 of the printer 10. In the housing 11, the sheet feeding tray 4 is disposed below the recording unit 6.

The sheet feeding tray 4 can support and accommodate therein a plurality of stacked sheets 9. The sheet feeding tray 4 can be taken in and out with respect to the housing 11 in the front and rear direction. The sheet feeding tray 4 has a support surface 4*a* for supporting the sheet 9. The sheet feeding tray 4 is provided at its rear end portion with a tilted plate 4*b*. The sheet 9 may be a label sheet of which a release sheet is laminated on an adhesive surface of an adhesive sheet, for example.

The sheet discharge tray 5 is configured to accommodate thereon the sheet 9 on which an image has been recorded by a recording head 63 of the recording unit 6, which will be described later. The sheet discharge tray 5 is disposed above a front side of the sheet feeding tray 4, and is adapted to move together with the sheet feeding tray 4.

The recording unit 6 includes a carriage 61, and a recording head 63. The carriage 61 is supported by two guide rails 67*a* and 67*b*. The two guide rails 67*a* and 67*b* are disposed with being spaced in the front and rear direction, and extend in the right and left direction, respectively. The carriage 61 is disposed to extend over the two guide rails 67*a* and 67*b*. The carriage 61 is configured to reciprocally move in the right and left direction, which is a main scanning direction, along the two guide rails 67*a* and 67*b* by a carriage drive motor 31 (refer to FIG. 2). The recording head 63 is mounted to the carriage 61, and is configured to reciprocally move in the main scanning direction together with the carriage 61. The recording head 63 is configured to discharge ink, which is supplied from an ink cartridge (not shown), from a plurality of nozzles (not shown) provided in a nozzle surface 69 of a lower surface, thereby forming a plurality of dots on the sheet 9 to record an image.

The conveyor unit 7 is provided so as to convey the sheet 9 in the printer 10, and includes a feeder roller 70, a pair of conveyor rollers 71, a pair of discharge rollers 72, a platen 75, and a guide member 17. Meanwhile, in descriptions below, a direction in which the sheet 9 is conveyed in the printer 10 by the conveyor unit 7 is referred to as "conveying direction".

The feeder roller 70 is disposed above the sheet feeding tray 4. The feeder roller 70 is configured to rotate by drive force applied from a feeder motor 33 (refer to FIG. 2), thereby delivering the sheet 9 in the sheet feeding tray 4 toward the rear. The pair of conveyor rollers 71 and the pair of discharge rollers 72 are disposed with sandwiching the recording unit 6 in the front and rear direction, and the pair of conveyor rollers 71 is disposed at the rear of the recording unit 6 and the pair of discharge rollers 72 is disposed in front of the recording unit 6. The pair of conveyor rollers 71 is configured to send the sheet 9 to a region facing the nozzle surface 69 of the recording head 63. The pair of discharge rollers 72 is configured to receive the sheet 9 sent by the pair of conveyor rollers 71, and to discharge the sheet 9 onto the sheet discharge tray 5. The pair of conveyor rollers 71 and the pair of discharge rollers 72 are configured to be driven by a drive mechanism 35 (refer to FIG. 2) including a conveyor motor 35*a*.

The platen 75 is disposed to face the nozzle surface 69 of the recording unit 6 below the recording unit 6. The guide member 17 defines a conveying path 14 for sending the sheet 9 delivered from the sheet feeding tray 4 into a region facing the nozzle surface 69 of the recording head 63. The guide member 17 extends from the vicinity of a rear end of the sheet feeding tray 4 to the vicinity of the pair of conveyor rollers 71.

The sheet 9 delivered rearward from the sheet feeding tray 4 by the feeder roller 70 is caused to face obliquely upward by the tilted plate 4*b* provided to the rear end portion of the sheet feeding tray 4, passes through the conveying path 14 defined by the guide member 17, and then reaches a position in which the sheet is sandwiched by the pair of conveyor rollers 71. The sheet 9 sandwiched by the pair of conveyor rollers 71 is conveyed to the region facing the nozzle surface 69 of the recording head 63 by the pair of conveyor rollers 71. On the sheet 9 conveyed by the pair of conveyor rollers 71, an image is recorded as ink is discharged from the nozzles (not shown) of the recording head 63 moving in the main scanning direction with being supported to the platen 75. The recorded sheet 9 is conveyed forward by the pair of discharge rollers 72, and is then discharged onto the sheet discharge tray 5.

Figure 2:
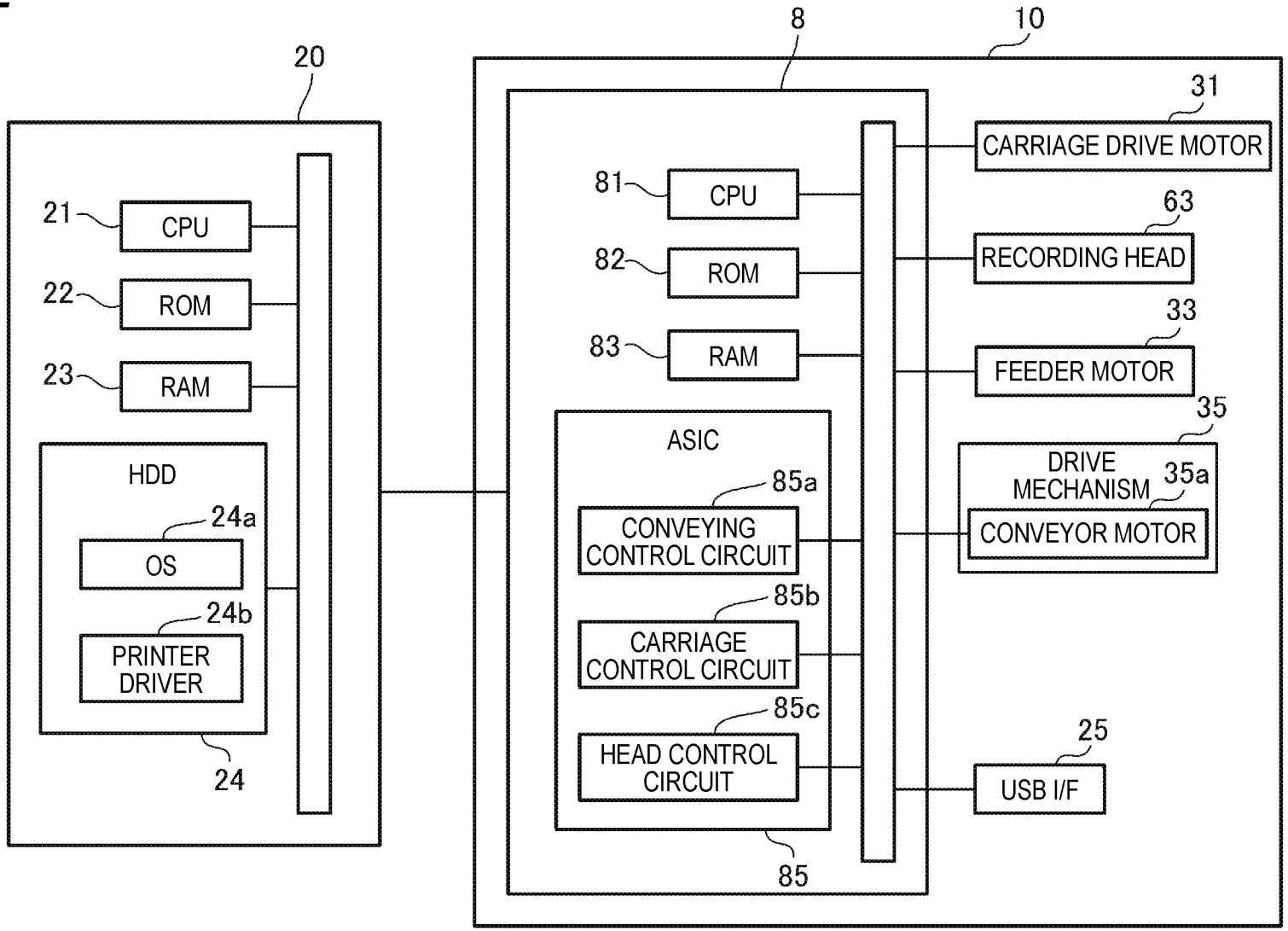
FIG. 2 is a block diagram schematically depicting electrical configurations of the printer shown in FIG. 1 and a PC connected to the printer.

The controller 8 is configured to control the printer 10 as a whole, and is electrically connected with the carriage drive motor 31, the recording head 63, the feeder motor 33, the drive mechanism 35 and the like, as shown in FIG. 2. Also, the controller 8 is electrically connected with a USB interface 25. The USB interface 25 is a USB standard interface, and a USB memory as a removable memory can be connected thereto. In addition, the controller 8 of the printer 10 is connected with a PC (Personal Computer) 20, which is an external device. In the meantime, the printer 10 and the PC 20 may be interconnected via a LAN (Local Area Network) or without via the LAN. Also, data transmission and reception between the printer 10 and the PC 20 may be performed in a wired or wireless communication manner.

The controller 8 includes a CPU (Central Processing Unit) 81, a ROM (Read Only Memory) 82, a RAM (Random Access Memory) 83, an ASIC (Application Specific Integrated Circuit) 85, and the like. In the ROM 82, programs to be executed by the CPU 81, various fixed data and the like are stored. In the RAM 83, data (image data and the like) that is necessary to execute the programs is temporarily stored. The ASIC 85 includes a conveying control circuit 85*a*, a carriage control circuit 85*b* and a head control circuit 85*c*.

The controller 8 is configured to execute an image recording operation of recording an image relating to image data, which is input from the USB memory or PC connected to the USB interface 25, on the sheet 9, through cooperation of the CPU 81 and the ASIC 85. In the meantime, in the image recording operation, the conveying control circuit 85*a* is configured to control the feeder motor 33 and the drive mechanism 35 so that the sheet 9 accommodated in the sheet feeding tray 4 is to be discharged to the sheet discharge tray 5 through the position facing the recording head 63. The carriage control circuit 85*b* is configured to control the carriage drive motor 31 so that the carriage 61 is to reciprocally move in the main scanning direction. Also, the head control circuit 85*c* is configured to control so that the ink is to be discharged from the nozzles (not shown) of the recording head 63, based on the image data stored in the RAM 83.

Here, in FIG. 2, one CPU 81 and one ASIC 85 are shown. However, the controller 8 may include only one CPU 81 and the one CPU 81 may be configured to collectively execute necessary processing, or may include a plurality of CPUs 81 and the plurality of CPUs 81 may be configured to share necessary processing. Also, the controller 8 may include only one ASIC 85 and the one ASIC 85 may be configured to collectively execute necessary processing, or may include a plurality of ASICs 85 and the plurality of ASICs 85 may be configured to share necessary processing.

The PC 20 includes a CPU 21, a ROM 22, a RAM 23, and an HDD (Hard Disk Drive) 24. In the HDD 24, an OS (Operation System) 24*a* and a printer driver 24*b* are installed. The CPU 21 can control operations of the printer 10 by executing the printer driver 24*b*.

Herein, the image data of the present embodiment is described. The present embodiment is directed to image data relating to an image including at least one of one-dimensional code image 41 (refer to FIG. 3A) and a two-dimensional code image 45 (refer to FIG. 3B). In descriptions below, one-dimensional code image 41 and the two-dimensional code image 45 are simply referred to as "code image 40" unless distinguished. Meanwhile, in the present embodiment, a case is also assumed in which a plurality of code images is included in the image relating to the image data. In this case, the plurality of code images is collectively referred to as "code image 40".

Figure 3A:
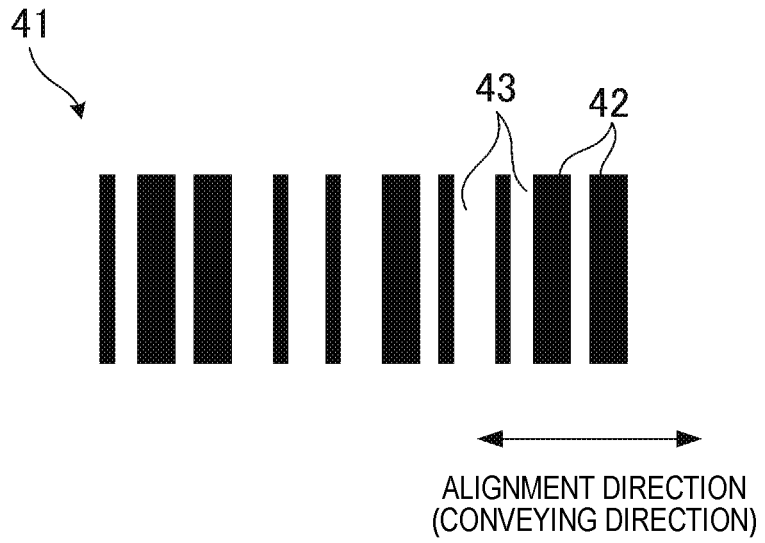
FIG. 3A illustrates one-dimensional code image.

As shown in FIG. 3A, one-dimensional code image 41 has a plurality of printing regions 42 and a plurality of non-printing regions 43. More specifically, the printing region 42 has a bar shape, and the plurality of printing regions 42 is spaced from each other with the non-printing region 43 being interposed therebetween. That is, one-dimensional code image 41 has a pattern in which the printing regions 42 and the non-printing regions 43 are alternately formed in one direction (a direction perpendicular to a longitudinal direction of the printing region 42). In descriptions below, the alignment direction (right and left direction in FIG. 3A) of the plurality of printing regions 42 is referred to as "alignment direction". The present embodiment is directed to one-dimensional code image 41 which is formed on the sheet 9 so that the conveying direction of the sheet 9 and the alignment direction coincide with each other.

In one-dimensional code image 41, each of the printing regions 42 and each of the non-printing regions 43 have one of a plurality of widths (lengths in the alignment direction) defined by standards, respectively. In one-dimensional code image 41, the widths of each of the printing regions 42 and each of the non-printing regions 43 are different, depending on information that is to be indicated by one-dimensional code image 41.

Figure 3B:
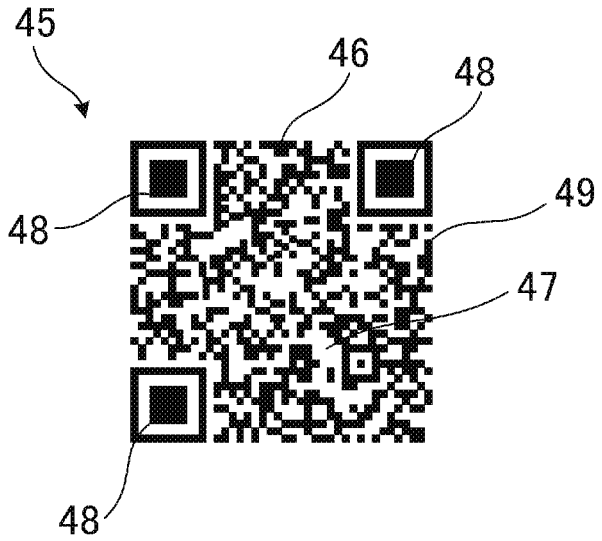
FIG. 3B illustrates a two-dimensional code image.

A two-dimensional code image 45 shown in FIG. 3B is a QR code (registered trademark). As shown in FIG. 3B, the two-dimensional code image 45 has a plurality of square-shaped printing regions 46 arranged in a mosaic shape in a square region 49 having sides extending in the upper and lower direction and sides extending in the right and left direction. That is, in the region 49, the printing regions 46 and the non-printing regions 47 are alternately formed both in the upper and lower direction and in the right and left direction. Also, Finder patterns 48 for detecting a position of the two-dimensional code image 45 in the upper and lower and the right and left directions are respectively formed at three corner portions (a right upper portion, a left upper portion and a left lower portion in FIG. 3B) of the square-shaped region 49.

The controller 8 is configured to intermittently execute conveying processing of conveying the sheet 9 in the conveying direction by the conveyor unit 7. Also, the controller 8 is configured to execute scanning processing of recording an image on the sheet 9 by the recording head 63 with moving the carriage 61 in the main scanning direction while the conveying processing is not executed.

Figure 4A:
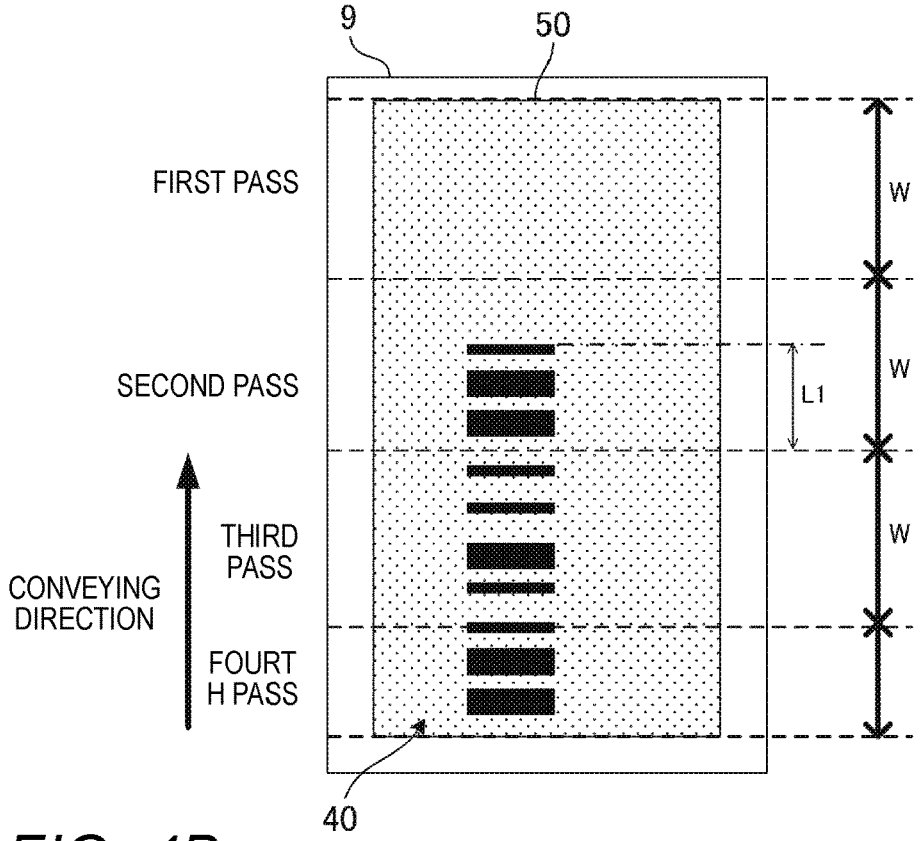
FIG. 4A illustrates a case in which an image is formed by executing conveying processing over a conveying distance decided in decision processing.

The controller 8 is configured to execute decision processing of deciding a conveying distance for the conveying processing, based on image data stored in the RAM 83. A specific example of the decision processing is described with reference to FIG. 4A. FIG. 4A depicts a case in which an image 50 including the code image 40 is formed on the sheet 9. Herein, a range, within which an image can be formed by the ink discharged from the recording head 63 when the carriage 61 is moved in the main scanning direction, is referred to as "image formation range". Also, a length of the image formation range in the conveying direction is referred to as "width W".

When forming one image 50 as shown in FIG. 4A on the sheet 9, the controller 8 refers to a position which is a downstream end (an upper end in FIG. 4A) of the image 50 in the conveying direction, executes the conveying processing of conveying the sheet 9 to a position which is a downstream end of the image formation range in the conveying direction, and then executes the scanning processing, based on the image data stored in the RAM 83 (data indicative of a position of the image 50 to be formed on the sheet 9, more specifically, a position of the downstream end of the image 50 in the conveying direction). That is, a part from the downstream end of the image 50 in the conveying direction to a width W of an image formation range is formed by first scanning processing (first pass). Then, the conveying processing of conveying the sheet 9 by the width W of the image formation range is executed. That is, the sheet 9 is conveyed to a position in which the part of the image 50 formed by the first pass is adjacent to a downstream side of an image formation range in the conveying direction. Then, second scanning processing (second pass) is executed. Thereby, a part corresponding to a width W of an image formation range and being adjacent to the part formed by the first pass is formed on a more upstream side than the part formed by the first pass in the conveying direction by the second pass.

In this way, in the decision processing, the conveying distance for the conveying processing to be executed before the first pass is decided according to the position of the image 50 in the image data, and the conveying distance for the subsequent conveying processing is decided as the width W of the image formation range on the sheet 9 in one conveying processing. That is, the image 50 is formed by the width W of the image formation range. Also, in the above example, the conveying distances for the conveying processing executed immediately before the second pass and the conveying processing thereafter may be appropriately decided according to a required image quality. In the meantime, in a case of forming a plurality of images with being spaced in the conveying direction on one sheet 9, the conveying distance may be determined so that a position of a downstream end of each image in the conveying direction is to coincide with the downstream end of the image formation range in the conveying direction.

The controller 8 is configured to determine whether an image including the code image 40 is to be formed on the sheet 9, based on the image data stored in the RAM 83 (first determination processing). The controller 8 is configured to determine whether the code image 40 is included in the image relating to the image data stored in the RAM 83 by analyzing the image data. In a case where the code image 40 is included in the image relating to the image data, it is determined that the image including the code image 40 is to be formed on the sheet 9. The determination as to whether the code image 40 is included in the image data may be made depending on whether an input, which indicates that an image is included in the code image 40, is made by a user. Also, information, which indicates that the code image 40 is included in the image, may be included in the image data.

In a case where it is determined in the first determination processing that the image including the code image 40 is to be formed on the sheet 9, the controller 8 determines whether the code image 40 is to be formed by a plurality of scanning processing if the conveying processing is executed over the conveying distance decided in the decision processing (second determination processing). In the example of FIG. 4A, if the conveying processing is executed over the conveying distance decided in the decision processing, the code image 40 included in the image 50 is formed by three scanning processing of second pass, third pass, and fourth pass.

Also, in a case where a length L3 of the code image 40 in the conveying direction is greater than the width W of the image formation range, the controller 8 executes coexistence code image determination processing of determining whether the code image 40 includes a plurality of code images aligned in the scanning direction (a plurality of code images of which positions in the conveying direction partially overlap). In a case where it is determined that the code image 40 does not include a plurality of code images aligned in the scanning direction, the controller executes reduction-possibility determination processing of determining whether the code image 40 can be reduced to a size that can be formed only by one scanning processing, i.e., the code image 40 can be reduced so that a length in the conveying direction is to be equal to or smaller than the width W of the image formation range.

Specifically, in the reduction-possibility determination processing, in a case where a width of the printing region 42 of one-dimensional code image 41 or a size of the printing region 46 of the two-dimensional code image 45 becomes a predetermined size or larger when the code image 40 is reduced to a size that can be formed only by one scanning processing, it is determined that the code image 40 can be reduced. On the other hand, it is determined that the code image 40 cannot be reduced in a case where the width of the printing region 42 of one-dimensional code image 41 or the size of the printing region 46 of the two-dimensional code image 45 becomes smaller than the predetermined size.

In the present embodiment, the predetermined size, which is a determination basis as to whether the code image 40 can be reduced in the reduction-possibility determination processing, is set to 2 dots. That is, a size of two dots, which are to be formed on the sheet 9 by ink droplets discharged from two adjacent nozzles (not shown) in the nozzle surface 69 of the recording head 63, is the predetermined size.

In a case where it is determined in the second determination processing that the code image 40 is to be formed by the plurality of scanning processing, the controller 8 executes shortening processing of shortening the conveying distance decided in the decision processing. In the shortening processing, the conveying distance decided in the decision processing is shortened for the conveying processing executed immediately before a first scanning processing (i.e., scanning processing corresponding to the second pass in FIG. 4A) of the plurality of scanning processing of forming the code image 40. More specifically, the shortening processing is executed so that the code image 40 is not to be formed by the first scanning processing of the plurality of scanning processing of forming the code image 40 and the code image 40 is started to be formed from a second scanning processing.

Figure 4B:
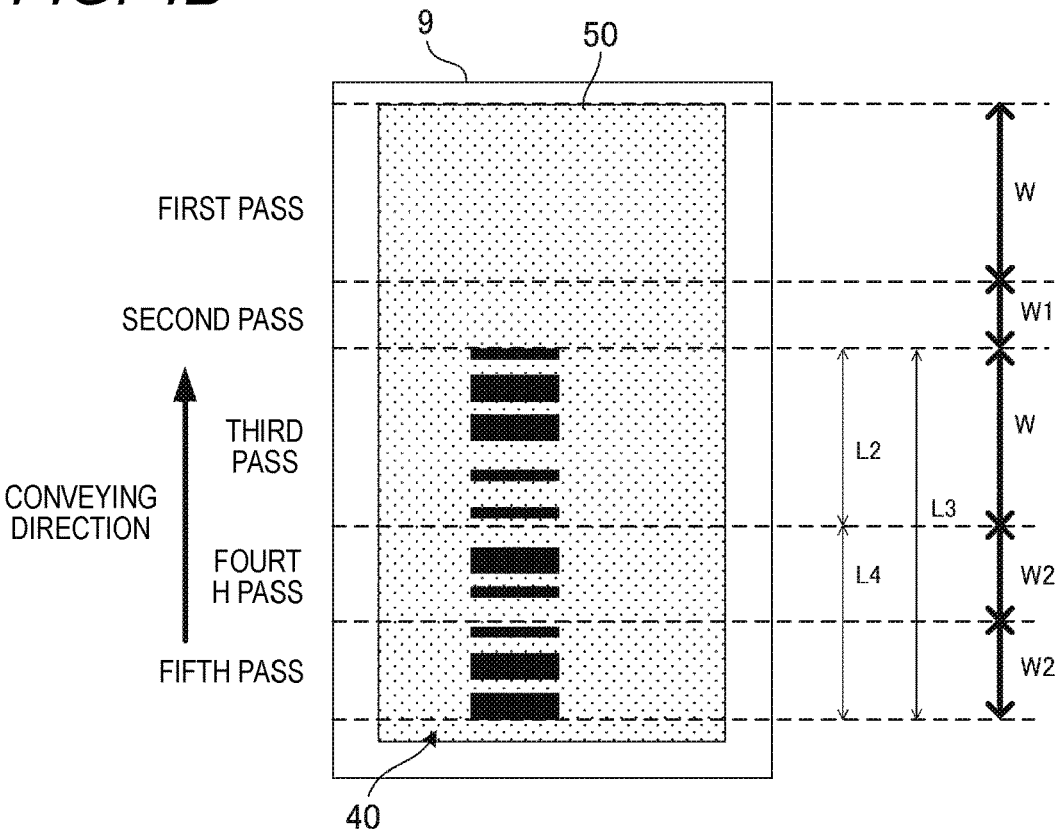
FIG. 4B illustrates shortening processing.

That is, in the example of FIG. 4B, in the shortening processing, the conveying distance of the conveying processing, which is executed immediately before the second pass scanning processing (scanning processing corresponding to the first scanning processing of the plurality of scanning processing of forming the code image 40 in FIG. 4A), is shortened to W1. That is, W1 is shorter than the second pass conveying distance W decided in the decision processing. Thereby, in the example of FIG. 4B, the code image 40 is not formed in the second pass scanning processing, and the code image 40 is started to be formed from the third pass scanning processing.

Herein, as shown in FIG. 4A, a length of the code image 40 in the conveying direction, which is formed by a first scanning processing (i.e., the scanning processing corresponding to second pass in FIG. 4A) as to the formation of the code image 40 when the shortening processing is not executed, is referred to as "L1". Also, as shown in FIG. 4B, a length of the code image 40 in the conveying direction, which is formed by a first scanning processing (i.e., the scanning processing corresponding to third pass in FIG. 4B) in which the code image 40 is started to be formed when the shortening processing is executed, is referred to as "L2". Here, L1 is shorter than L2.

In a case in which the length L3 of the code image 40 in the conveying direction is greater than the width W of the image formation range, when it is determined in the coexistence code image determination processing that the plurality of code images is included or when it is determined in the reduction-possibility determination processing that the code image 40 cannot be reduced, the code image 40 is formed by the plurality of scanning processing. In this case, as shown in FIG. 4B, the shortening processing is executed so that the code image 40 is to be formed over an entire length (width W) of the image formation range in the first scanning processing (scanning processing corresponding to third pass in FIG. 4B) of forming the code image 40.

Figure 5A:
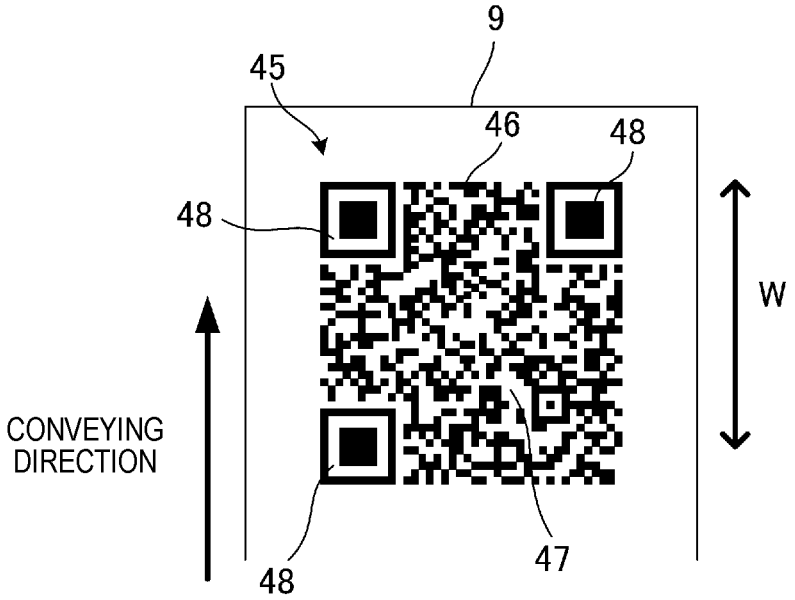
FIGS. 5A and 5B illustrate scanning processing that is first executed when forming a two-dimensional barcode image.
Figure 5B:
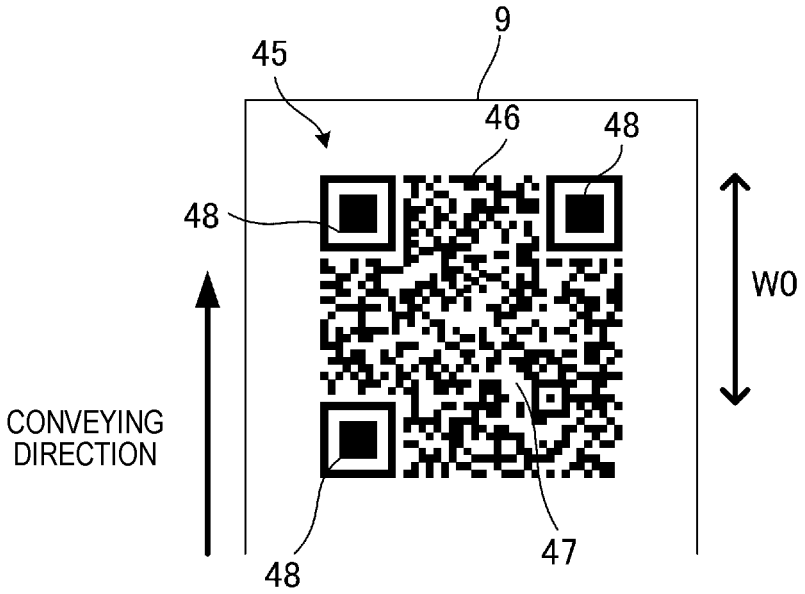

In the meantime, in a case in which the code image 40 is the two-dimensional code image 45, the controller 8 forms each Finder pattern 48 by one scanning processing. Therefore, in the first scanning processing of forming the two-dimensional code image 45, when the two-dimensional code image 45 is formed over the entire length (width W) of the image formation range, if there is a Finder pattern which is partially formed among the three Finder patterns 48, the width of the two-dimensional code image 45 to be formed by the first scanning processing is set shorter than the width W of the image formation range. That is, in the example of FIG. 5A, when the first scanning processing of forming the two-dimensional code image 45 over the width W of the image formation range is executed, the Finder pattern 48 located at the left lower part is partially formed. Therefore, as shown in FIG. 5B, a width of the first scanning processing is set to W0 (<W), and the shortening processing is executed so that a part up to a downstream end of the Finder pattern 48 in the conveying direction, which is located at the left lower part, is to be formed by the first scanning processing.

Also, as shown in FIG. 4B, in a case in which a length L4 in the conveying direction of a remaining part except the part formed by the first scanning processing of forming the code image 40 is greater than the width W of the image formation range, i.e., the remaining part of the code image 40 cannot be formed by one scanning processing, the remaining part of the code image 40 is equally divided so as to minimize the number of times of the scanning processing and is then formed by a plurality of scanning processing. That is, the length L4 in the conveying direction of the remaining part of the code image 40 is equally divided into lengths shorter than the width W of the image formation range, and the plurality of scanning processing is executed over the equally divided widths. In the example of FIG. 4B, the remaining part of the code image 40 is divided into two parts having a length W2 (<W). In the meantime, in the case in which the code image 40 is the two-dimensional code image 45, when equally dividing the remaining part of the code image 40, the remaining part is divided so that the Finder pattern 48 is to be formed by one scanning processing.

In a case where it is determined in the reduction-possibility determination processing that the code image 40 can be reduced, the controller 8 executes reduction processing of reducing a size of the code image 40 in the image data stored in the RAM 83. Specifically, the size of the code image 40 is reduced so that the entire code image 40 is to be formed by one scanning processing in the first scanning processing (scanning processing corresponding to third pass in FIG. 4B) in which the formation of the code image 40 is to be started.

Also, in a case where the length L3 of the code image 40 in the conveying direction is equal to or smaller than the width W of the image formation range, the controller 8 executes the shortening processing so that the entire code image 40 is to be formed by one scanning processing in the first scanning processing (scanning processing corresponding to third pass in FIG. 4B) in which the formation of the code image 40 is to be started.

Figures 6, 6A:
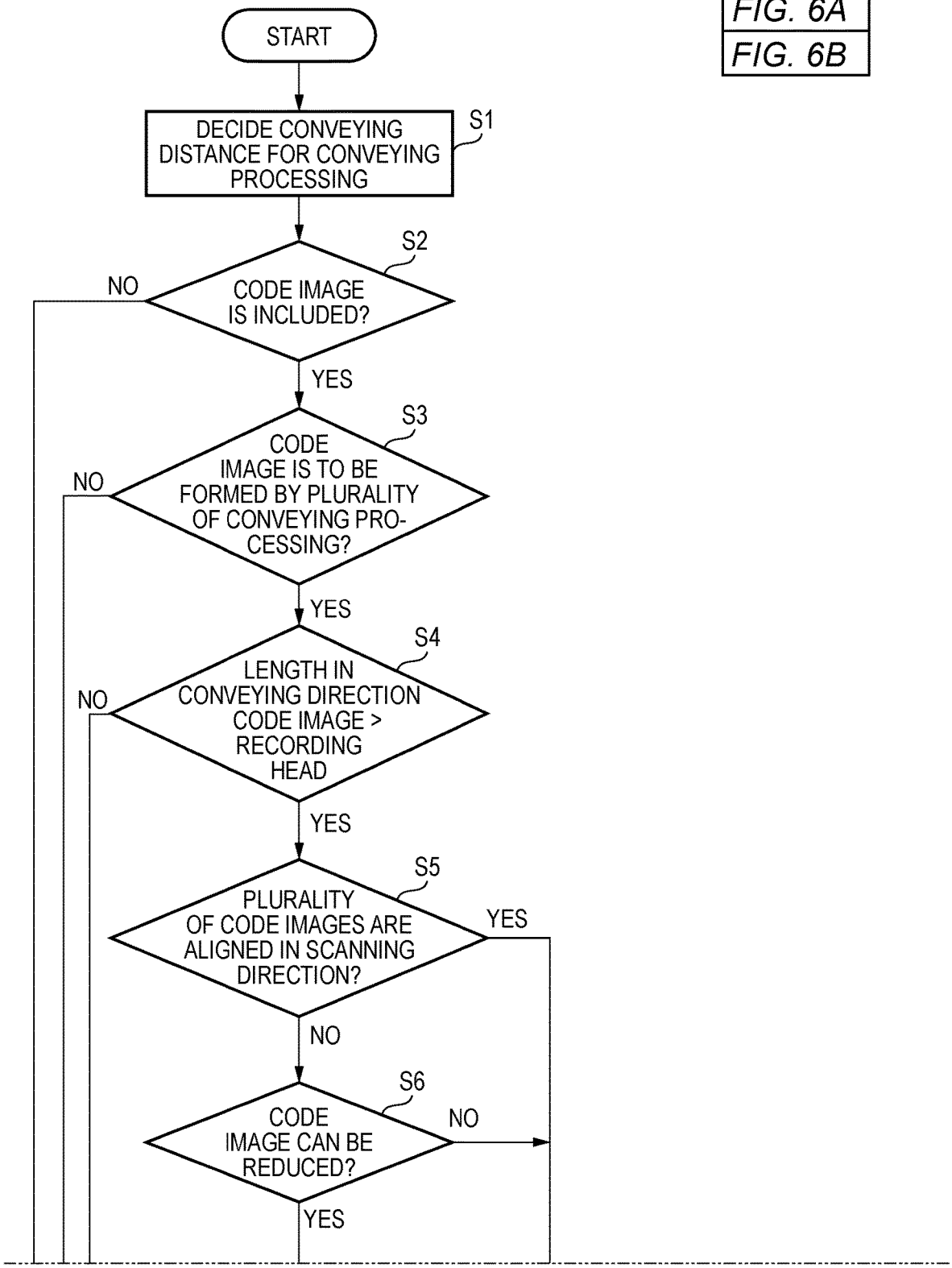
FIGS. 6A and 6B shows a flowchart depicting an example of a processing sequence that is executed by a controller shown in FIG. 1.
Figure 6B:
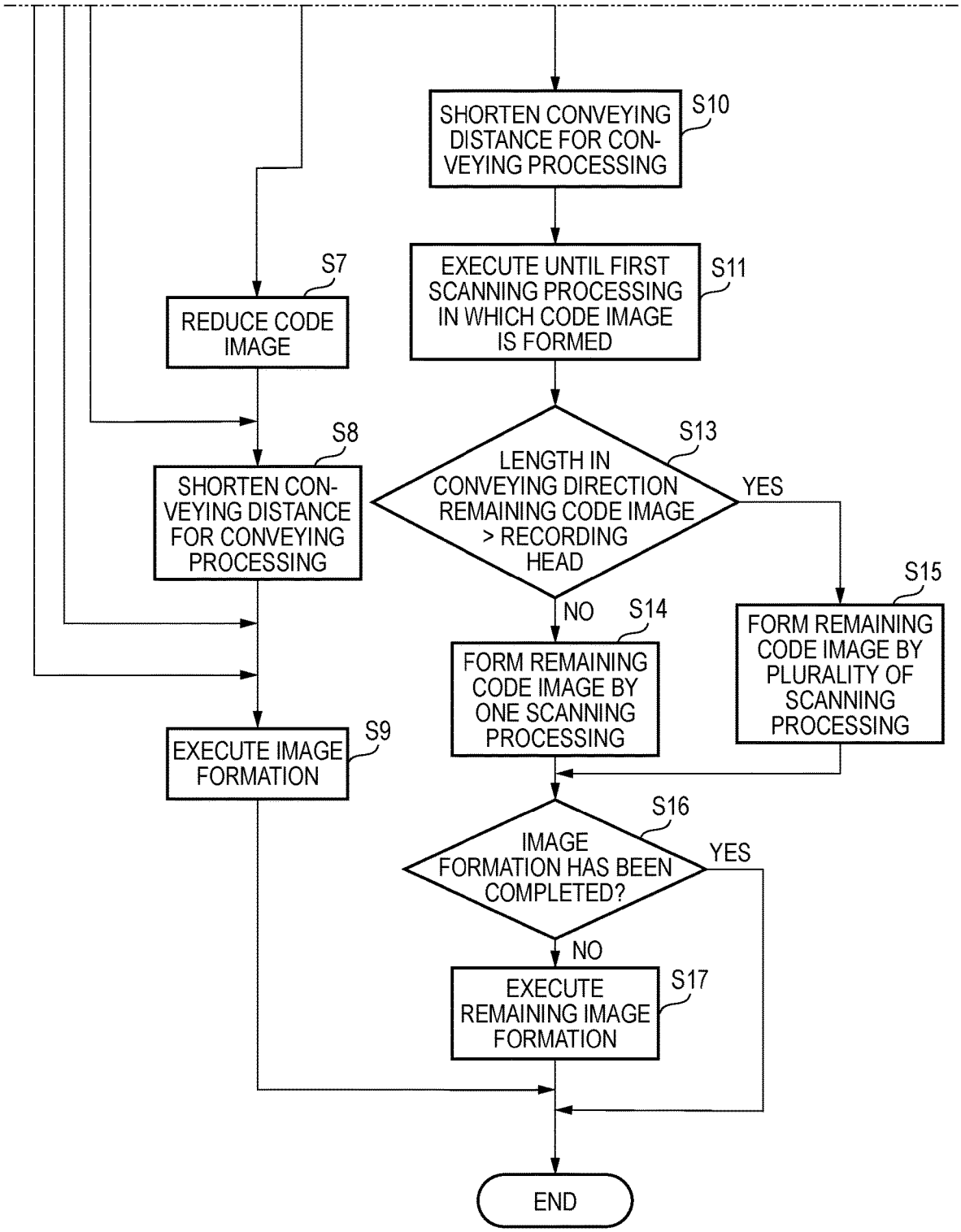

Herein, an example of a processing sequence that is to be executed by the controller 8 when forming an image relating to the image data stored in the RAM 83 on the sheet 9 is described with reference to FIGS. 6A and 6B. First, the controller 8 executes the decision processing of deciding the conveying distance for the conveying processing based on the image data stored in the RAM 83 (step S1). Then, based on the image data stored in the RAM 83, the controller 8 determines whether an image including the code image 40 is to be formed on the sheet 9 (step S2).

In a case where it is determined that the code image 40 is not included in the image data stored in the RAM 83 and the image including the code image 40 is not to be formed on the sheet 9 (step S2: NO), the controller 8 proceeds to step S9, which will be described later. On the other hand, in a case where it is determined that the code image 40 is included in the image data stored in the RAM 83 and the image including the code image 40 is to be formed on the sheet 9 (step S2: YES), the controller 8 determines whether the code image 40 is to be formed by the plurality of scanning processing if the conveying processing is executed over the conveying distance decided in step S1 (step S3).

In a case where it is determined that the code image 40 is not to be formed by the plurality of scanning processing (step S3: NO), the controller 8 proceeds to step S9, which will be described later. On the other hand, in a case where it is determined that the code image 40 is to be formed by the plurality of scanning processing (step S3: YES), the controller 8 determines whether the length L3 of the code image 40 in the conveying direction is greater than the length (width W) of the image formation range in the conveying direction (step S4).

In a case where it is determined that the length L3 of the code image 40 in the conveying direction is equal to or smaller than the length (width W) of the image formation range in the conveying direction (step S4: NO), the controller 8 proceeds to step S8, which will be described later. On the other hand, in a case where it is determined that the length L3 of the code image 40 in the conveying direction is greater than the length (width W) of the image formation range in the conveying direction (step S4: YES), the controller 8 determines whether the code image 40 includes a plurality of code images aligned in the scanning direction (step S5).

In a case where it is determined that the code image 40 does not include a plurality of code images aligned in the scanning direction (step S5: NO), the controller 8 determines whether the code image 40 can be reduced to a size that can be formed only by one scanning processing (step S6). In a case where it is determined that the code image 40 can be reduced to a size that can be formed only by one scanning processing (step S6: YES), the controller 8 reduces the size of the code image 40 in the image data stored in the RAM 83 to the size that can be formed only by one scanning processing (step S7).

Subsequently, the controller 8 executes the shortening processing of shortening the conveying distance decided in step S1 (S8). Specifically, in the case in which an image is formed by executing the conveying processing over the conveying distance decided in step S1, the controller 8 shortens the conveying distance so that the code image 40 is not to be formed by the first scanning processing of the plurality of scanning processing of forming the code image 40 and the code image 40 is started to be formed from the second scanning processing. In this case, the code image 40 for which it has been determined in step S4 that the length L3 in the conveying direction is equal to or smaller than the length (width W) of the image formation range in the conveying direction and the code image 40 that has been reduced to the size that can be formed only by one scanning processing in step S7 are formed only by one time of the first scanning processing of forming the code image 40. Then, the controller 8 executes the formation of an image relating to the image data stored in the RAM 83 (S9), and ends the processing.

In a case where it is determined in step S5 that the code image 40 includes the plurality of code images aligned in the scanning direction (step S5: YES) or in a case where it is determined in step S6 that the code image 40 cannot be reduced to the size that can be formed only by one scanning processing (step S6: NO), the controller 8 executes the shortening processing of shortening the conveying distance determined in step S1, like step S8 (step S10). In this case, in the first scanning processing of forming the code image 40, the code image 40 is formed over the entire length (width W) of the image formation range. However, the present embodiment is not limited thereto if the code image 40 is the two-dimensional code image 45, and only a part of the Finder pattern 48 is formed when the two-dimensional code image 45 is formed over the entire length of the image formation range in the first scanning processing. In this case, the width of the two-dimensional code image 45, which is to be formed in the first scanning processing, is set shorter than the width W of the image formation range so that the corresponding Finder pattern 48 is to be formed in subsequent scanning processing.

Subsequently, the controller 8 executes the execution until the first scanning processing (for example, third pass in FIG. 4B) in which the code image 40 is formed (step S11). Also, the controller 8 determines whether the length LA in the conveying direction of the remaining part except the part of the code image 40 formed in the first scanning processing is greater than the length (width W) of the image formation range in the conveying direction (step S13). In a case where it is determined that the length L4 of the remaining part of the code image 40 is equal to or smaller than the width W of the image formation range (step S13: NO), the controller 8 forms the remaining part of the code image 40 by one scanning processing (step S14). Then, the controller 8 proceeds to step S16, which will be described later.

On the other hand, in a case where it is determined that the length L4 of the remaining part of the code image 40 is greater than the length (width W) of the image formation range in the conveying direction (step S13: YES), the controller 8 equally divides the remaining part of the code image 40 so that the number of times of the scanning processing is minimized, and forms the same by the plurality of scanning processing (step S15). Then, the controller 8 determines whether the formation of the image relating to the image data stored in the RAM 83 has been completed (step S16). In a case where it is determined that the formation of the image has been completed (step S16: YES), the controller 8 ends the processing without executing step S17, which will be described later. On the other hand, in a case where it is determined that the formation of the image has not been completed yet (step S16: NO), the controller 8 executes formation of a remaining image (step S17), and ends the processing.

As described above, the controller 8 of the printer 10 in accordance with the above-described embodiment executes the conveying processing in which the sheet 9 is conveyed in the conveying direction by the conveyor unit 7, the scanning processing in which the image is recorded on the sheet 9 by the recording head 63 with moving the carriage 61 in the main scanning direction when the conveying processing is not executed, and the decision processing of deciding the conveying distance for the conveying processing based on the image data stored in the RAM 83. Also, the controller 8 executes the first determination processing of determining whether an image including the code image 40 is to be formed on the sheet 9 based on the image data stored in the RAM 83, and the second determination processing of determining, in a case where it is determined in the first determination processing that an image including the code image 40 is to be formed on the sheet 9, whether the code image 40 is to be formed by the plurality of scanning processing if the conveying processing is executed over the conveying distance decided in the decision processing. The controller 8 executes the shortening processing of, in a case where it is determined in the second determination processing that the code image 40 is to be formed by the plurality of scanning processing, shortening the conveying distance decided in the decision processing for the conveying processing which is executed immediately before the first scanning processing, so that the code image 40 is not to be formed in the first scanning processing of the plurality of scanning processing and the code image 40 is started to be formed from the second scanning processing. The length L1 of the code image 40 in the conveying direction, which is formed in the first scanning processing as to the formation of the code image 40 when the shortening processing is not executed, is shorter than the length L2 of the code image 40 in the conveying direction, which is formed in the first scanning processing in which the code image 40 is started to be formed when the shortening processing is executed.

Therefore, since the code image 40 can be formed by the scanning as few times as possible, it is possible to reduce the number of times of the conveying processing that is to be executed during the formation of the code image 40. For this reason, even when the conveying accuracy of the sheet 9 is not high, the lowering in image quality of the code image 40 can be suppressed, so that it is possible to print the code image 40 having high reading accuracy.

Also, according to the printer 10 of the above-described embodiment, in a case where the length L3 of the code image 40 in the conveying direction is equal to or smaller than the length (width W) of the image formation range in the conveying direction, the shortening processing is executed so that the code image 40 is to be formed by one scanning processing. Therefore, it is possible to exclude an influence of a conveying error in the conveying processing on the code image 40. Thereby, it is possible to further suppress the lowering in image quality of the code image 40.

Also, according to the printer 10 of the above-described embodiment, in a case where the length L3 of the code image 40 in the conveying direction is greater than the length (width W) of the image formation range in the conveying direction, the shortening processing is executed so that the code image 40 is to be formed over the entire length (width W) of the image formation range in the first scanning processing of forming the code image 40. Therefore, it is possible to further suppress the lowering in image quality of the code image 40.

In addition, according to the printer 10 of the above-described embodiment, in a case where the length L3 of the code image 40 in the conveying direction is greater than the length (width W) of the image formation range in the conveying direction, the size of the code image 40 in the image data stored in the RAM 83 is reduced so that the entire code image 40 is to be formed by one scanning processing of the first scanning processing of forming the code image 40. Therefore, it is possible to further suppress the lowering in image quality of the code image 40.

Also, according to the printer 10 of the above-described embodiment, the code image 40 is formed as one-dimensional code image 41 having a pattern in which the printing regions 42 and the non-printing regions 43 are alternately formed in the alignment direction, and is formed on the sheet 9 so that the alignment direction and the conveying direction of the sheet 9 coincide with each other. According to this configuration, it is possible to suppress the lowering in image quality of the one-dimensional code image.

Also, according to the printer 10 of the above-described embodiment, the code image 40 is the two-dimensional code image 45 in which the printing regions 46 and the non-printing regions 47 are alternately formed both in both the upper and lower direction and in the right and left direction. According to this configuration, it is possible to suppress the lowering in image quality of the two-dimensional code image.

Also, according to the printer 10 of the above-described embodiment, the conveying distance decided in the decision processing is shortened in the shortening processing so that the Finder pattern 48 is to be formed by one scanning processing. Therefore, it is possible to form the Finder pattern 48 with high accuracy.

Although the embodiment of the present disclosure has been described with reference to the drawings, the specific configuration is not limited to the embodiment. The scope of the present disclosure is defined by the claims, not the description of the embodiment, and includes all changes within the meaning and scope equivalent to the claims.

In the above-described embodiment, in a case where it is determined that the code image 40 is to be formed by the plurality of conveying processing if the conveying processing is executed over the conveying distance decided in the decision processing, the controller 8 provided in the printer 10 executes the shortening processing of shortening the conveying distance decided in the decision processing. However, the present disclosure is not limited thereto. That is, for example, the printer driver 24*b* (refer to FIG. 1) installed in the HDD 24 of the PC 20 connected to the printer 10 may be configured to cause the PC 20 to execute a storing processing of storing the image data in the RAM 83, the decision processing of deciding the conveying distance for the conveying processing based on the image data stored in the RAM 83, the first determination processing of determining whether an image including the code image 40 is to be formed on the sheet 9 based on the image data stored in the RAM 83, the second determination processing of, in a case where it is determined in the first determination processing that the image including the code image 40 is to be formed on the sheet 9, determining whether the code image 40 is to be formed by the plurality of scanning processing if the conveying processing is executed over the conveying distance decided in the decision processing, and the shortening processing of, in a case where it is determined in the second determination processing that the code image 40 is to be formed by the plurality of scanning processing, shortening the conveying distance decided in the decision processing for the conveying processing which is executed immediately before the first scanning processing, so that the code image 40 is not to be formed in the first scanning processing of the plurality of scanning processing and the code image 40 is started to be formed from the second scanning processing.

Also, according to the above-described embodiment, in the shortening processing, the conveying distance decided in the decision processing is shortened for the conveying processing which is executed immediately before the first scanning processing of the plurality of scanning processing of forming the code image 40 when the conveying processing is executed over the conveying distance decided in the decision processing. However, the present disclosure is not limited thereto. That is, in the shortening processing, the conveying distance decided in the decision processing may be shortened for: (i) one conveying processing which is executed immediately before the first scanning processing; or (ii) at least one of a plurality of conveying processing which are respectively executed immediately before each of a plurality of scanning processing which includes the first scanning processing and at least one scanning processing executed before the first scanning processing.

Also, according to the above-described embodiment, in a case where the length L3 of the code image 40 in the conveying direction is equal to or smaller than the length (width W) of the image formation range in the conveying direction, the shortening processing is executed so that the code image 40 is to be formed by one scanning processing. However, the present disclosure is not limited thereto. That is, even when the length L3 of the code image 40 in the conveying direction is equal to or smaller than the length (width W) of the image formation range in the conveying direction, the code image 40 may be formed by a plurality of scanning processing.

Also, according to the above-described embodiment, in a case where the length L3 of the code image 40 in the conveying direction is greater than the length (width W) of the image formation range in the conveying direction, the shortening processing is executed so that the code image 40 is to be formed over the entire length (width W) of the image formation range in the first scanning processing of forming the code image 40. However, the present disclosure is not limited thereto. That is, in the first scanning processing of forming the code image 40, the code image 40 may be formed over a width smaller than the width W of the image formation range.

In addition, according to the above-described embodiment, in a case where the length L3 of the code image 40 in the conveying direction is greater than the length (width W) of the image formation range in the conveying direction, the reduction processing of reducing the size of the code image 40 in the image data is executed so that the entire code image 40 is to be formed by one scanning processing of the first scanning processing of forming the code image 40. However, such reduction processing does not necessarily need to be executed.

Also, according to the above-described embodiment, the two-dimensional code image 45 is a QR code (registered trademark). However, the present disclosure is not limited thereto. That is, the present disclosure can also be applied to a two-dimensional code image such as a DataMatrix (registered trademark).

Also, according to the above-described embodiment, the Finder pattern 48 is formed by one scanning processing. However, the Finder pattern 48 may also be formed by a plurality of scanning processing.

Also, according to the above-described embodiment, the present disclosure is applied to the printer 10. However, the present disclosure is not limited thereto. The present disclosure can also be applied to any apparatus such as a complex machine, a copier and the like inasmuch as the apparatus performs image formation in a serial manner of alternately repeating the conveying processing and the scanning processing.

What is claimed is:

1. An image forming apparatus comprising:

a memory;

a recording head configured to record an image on a recording medium based on image data stored in the memory;

a conveyor unit configured to convey the recording medium in a conveying direction;

a carriage having the recording head mounted thereto and capable of reciprocally moving in a scanning direction perpendicular to the conveying direction; and a controller configured to:

execute a conveying processing in which the recording medium is conveyed in the conveying direction by the conveyor unit;

execute a scanning processing in which the image is recorded on the recording medium by the recording head with moving the carriage in the scanning direction when the conveying processing is not executed;

decide a conveying distance for the conveying processing based on the image data stored in the memory;

determine whether an image including a code image having a plurality of printing regions and a plurality of non-printing regions is to be formed on the recording medium based on the image data stored in the memory;

determine, in a case where it is determined that the image including the code image is to be formed on the recording medium, whether the code image is to be formed by a plurality of the scanning processing including a first scanning processing and a second scanning processing if the conveying processing is executed over the decided conveying distance; and shorten, in a case where it is determined that the code image is to be formed by the plurality of scanning processing, the decided conveying distance for: (i) one conveying processing which is executed immediately before the first scanning processing; or (ii) at least one of a plurality of conveying processing which are respectively executed immediately before each of a plurality of scanning processing which includes the first scanning processing and at least one scanning processing executed before the first scanning processing, so that the code image is not to be formed in the first scanning processing and the code image is started to be formed from the second scanning processing, wherein a length of the code image in the conveying direction, which is formed in the first scanning processing when the decided conveying distance is not shortened, is shorter than a length of the code image in the conveying direction, which is formed in the second scanning processing when the decided conveying distance is shortened.

2. The image forming apparatus according to claim 1, wherein, in a case where a length of the code image in the conveying direction is equal to or smaller than a length of an image formation range in the conveying direction by the recording head mounted to the carriage, the decided conveying distance is shortened so that the code image is to be formed by one scanning processing.

3. The image forming apparatus according to claim 1, wherein, in a case where a length of the code image in the conveying direction is greater than a length of an image formation range in the conveying direction by the recording head mounted to the carriage, the decided conveying distance is shortened so that the code image is to be formed over an entire length of the image formation range in the second scanning processing.

4. The image forming apparatus according to claim 1, wherein the controller is further configured to:

reduce, in a case where a length of the code image in the conveying direction is greater than a length of an image formation range in the conveying direction by the recording head mounted to the carriage, a size of the code image in the image data stored in the memory so that the code image is to be formed only by the second scanning processing.

5. The image forming apparatus according to claim 1, wherein the code image is one-dimensional code image having a pattern in which the plurality of printing regions and the plurality of non-printing regions are alternately formed in a predetermined direction, and is formed on the recording medium so that the conveying direction and the predetermined direction coincide with each other.

6. The image forming apparatus according to claim 1, wherein the code image is a two-dimensional code image having a pattern in which the plurality of printing regions and the plurality of non-printing regions are alternately formed both in a first predetermined direction and in a second predetermined direction perpendicular to the first predetermined direction.

7. The image forming apparatus according to claim 6, wherein the decided conveying distance is shortened so that a Finder pattern in the two-dimensional code image is to be formed by one scanning processing.

8. A non-transitory computer readable storage medium storing a program used for an electronic device configured to control an image forming apparatus, the image forming apparatus including:

a memory;

a recording head configured to record an image on a recording medium based on image data stored in the memory;

a conveyor unit configured to convey the recording medium in a conveying direction;

a carriage having the recording head mounted thereto and capable of reciprocally moving in a scanning direction perpendicular to the conveying direction; and a controller configured to:

execute a conveying processing in which the recording medium is conveyed in the conveying direction by the conveyor unit, and execute a scanning processing in which the image is recorded on the recording medium by the recording head with moving the carriage in the scanning direction when the conveying processing is not executed, the program, when executed by a processor of the electronic device, causes the electronic device to:

store image data in the memory;

decide a conveying distance for the conveying processing based on the image data stored in the memory;

determine whether an image including a code image having a plurality of printing regions and a plurality of non-printing regions is to be formed on the recording medium based on the image data stored in the memory;

determine, in a case where it is determined that the image including the code image is to be formed on the recording medium, whether the code image is to be formed by a plurality of the scanning processing including a first scanning processing and a second scanning processing if the conveying processing is executed over the decided conveying distance; and shorten, in a case where it is determined that the code image is to be formed by the plurality of scanning processing, the decided conveying distance for: (i) one conveying processing which is executed immediately before the first scanning processing; or (ii) at least one of a plurality of conveying processing which are respectively executed immediately before each of a plurality of scanning processing which includes the first scanning processing and at least one scanning processing executed before the first scanning processing, so that the code image is not to be formed in the first scanning processing and the code image is started to be formed from the second scanning processing, and wherein a length of the code image in the conveying direction, which is formed in the first scanning processing when the decided conveying distance is not shortened, is shorter than a length of the code image in the conveying direction, which is formed in the second scanning processing when the decided conveying distance is shortened.

* * * * *